United States Patent [19]

Wood

[11] Patent Number: 4,672,386

[45] Date of Patent: Jun. 9, 1987

[54] ANTENNA WITH RADIAL AND EDGE SLOT RADIATORS FED WITH STRIPLINE

[75] Inventor: Colin Wood, Hampshire, England

[73] Assignee: Plessey Overseas Limited, Ilford, England

[21] Appl. No.: 688,816

[22] Filed: Jan. 4, 1985

[30] Foreign Application Priority Data

Jan. 5, 1984 [GB] United Kingdom ..... 8400153

[51] Int. Cl.[4] ..... H01Q 1/38; H01Q 13/10

[52] U.S. Cl. ..... 343/770; 343/846

[58] Field of Search ..... 343/770, 768, 769, 829, 343/830, 846, 708, 700 MS

[56] References Cited

U.S. PATENT DOCUMENTS 3,832,716 8/1974 Plunk et al. ..... 343/770
4,242,685 12/1980 Sanford ..... 343/770
4,443,802 4/1984 Mayes ..... 343/770
4,547,779 10/1985 Sanford et al. ..... 343/700 MS

FOREIGN PATENT DOCUMENTS 16302 2/1981 Japan ..... 343/767

*Primary Examiner*—Eli Lieberman
*Assistant Examiner*—Michael C. Wimer
*Attorney, Agent, or Firm*—Fleit, Jacobson, Cohn & Price

[57] ABSTRACT

An antenna suitable for the generation of a circularly polarized annular radiation pattern comprising a substrate spaced apart from a ground plane by a layer of dielectric material, the substrate being arranged to carry on one side thereof a conductive layer in which a plurality of radial slots is defined equiangularly disposed to extend outwardly from a central region of the substrate, and on the other side thereof a microstrip feed line arrangement via which the radial slots are arranged to be fed with microwave energy for the generation of a horizontally polarized radiation pattern and via which an edge slot defined between the peripheral edge of the layer and the ground plane is arranged to be fed with microwave energy for the generation of a vertically polarized radiation pattern whereby the horizontal pattern and the vertical pattern in combination afford the circularly polarized annular radiation pattern.

5 Claims, 6 Drawing Figures

ANTENNA WITH RADIAL AND EDGE SLOT RADIATORS FED WITH STRIPLINE

This invention relates to antennas and more particularly it relates to microwave antennas suitable for the generation of a circularly polarised annular radiation pattern.

Antennas for the generation of such radiation patterns are known and known antennas comprise bulky multimode spiral or blade antennas which have the serious disadvantage of presenting a large profile which is unsuitable for some applications.

It is an important object of the present invention to provide a low profile antenna suitable for use on aircraft.

SUMMARY

According to the present invention an antenna suitable for the generation of a circularly polarised annular radiation pattern comprises a substrate spaced apart from a ground plane by a layer of dielectric material, the substrate being arranged to carry on one side thereof a conductive layer in which a plurality of radial slots is defined equiangularly disposed to extend outwardly from a central region of the substrate, and on the other side thereof a microstrip feedline arrangement via which the radial slots are arranged to be fed with microwave energy for the generation of a horizontally polarised radiation pattern and via which an edge slot defined between the peripheral edge of the layer and the ground plane is arranged to be fed with microwave energy for the radiation of a vertically polarised radiation pattern, whereby the horizontal pattern and the vertical pattern in combination afford the circularly polarised annular radiation pattern.

Four radial slots may be provided arranged at 90° angular intervals to extend radially outwardly from a central region of the substrate to the peripheral edge of the conductive layer.

The conductive layer may be provided adjacent the layer of dielectric material.

The microstrip feedline arrangement may be arranged to be fed from a coaxial connector positioned on the ground plane side of the antenna.

The microstrip feedline may comprise printed conductors which are fed via a centrally disposed feed conductor from the coaxial connector and which are linked through the substrate at a plurality of locations to the ground plane for edge slot feeding purposes, and which are preferably linked through the substrate at a further plurality of locations to the conductive layer for radial slot feeding purposes.

Alternatively radial slot feeds may comprise an open circuited length of microstrip line rather than through substrate links.

The edge slots may be fed at four equiangularly disposed locations and the radial slots may each be fed from a location adjacent to each slot so that four feed locations are provided for the radial slots which are symmetrically disposed with respect to the central feed conductor.

BRIEF DESCRIPTION OF THE DRAWINGS

One embodiment of the invention will now be described by way of example with reference to the accompanying drawings in which.

DETAILED DESCRIPTION

Figure 6:
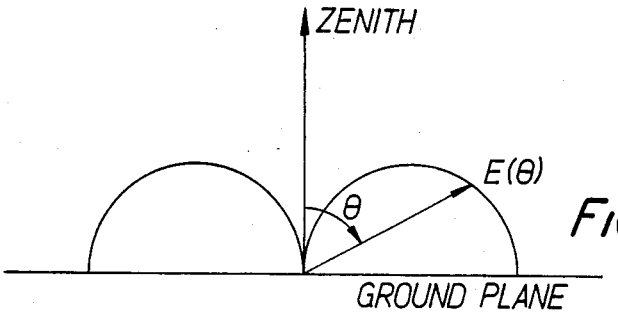
FIG. 6 is a polar diagram illustrating the radiation pattern associated with the antenna shown in FIGS. 1 and 2.

Referring now to the drawings wherein corresponding parts bear as appropriate the same numerical designations an antenna comprises a printed circuit board substrate 1 on one side of which a copper microstrip feedline arrangement 2 is formed and on the other side of which a copper conductive layer 3 is laid down in which radially extending slots 4 are formed. The radial slots 4 are disposed at 90° angular intervals and are arranged to be fed with microwave energy from the microstrip feedline arrangement 2 for the generation of a horizontally polarised radiation pattern and an edge slot 5 defined between the peripheral edge of the conductive layer 3 and a ground plane 6 is arranged to be fed with microwave energy from the microstrip feedline arrangement 2 for the radiation of a vertically polarised radiation pattern. In combination, the vertical and horizontal polarisation patterns combine to define a circularly polarised annular radiation pattern as shown in FIG. 6. The radiation pattern is in effect a circularly polarised dipole-like pattern which is rotationally symmetrical.

Figure 5:
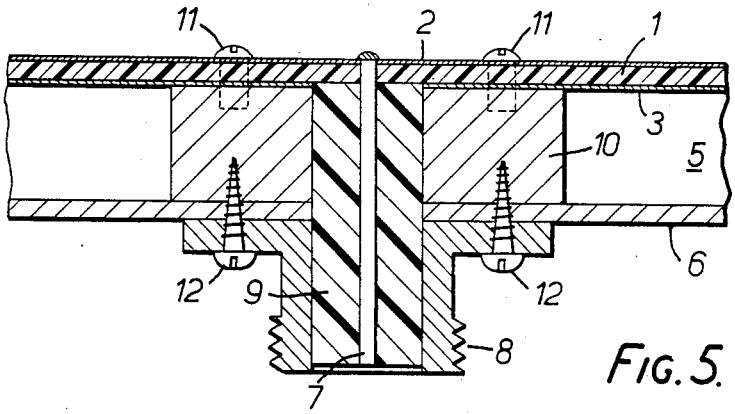
FIG. 5 is a sectional view on a line ZZ as shown in FIG. 2.

The microstrip feedline arrangement 2 is fed from the central conductor 7 (FIG. 5) of a coaxial socket connector 8. The central conductor 7 is insulated by a plastics insulator region 9 which forms part of the socket connector 8. The conductor 7 passes through the printed circuit board 1 to be coupled as by means of soldering to the microstrip feedline 2. The ground plane 6, which may comprise a sheet of aluminium, is spaced apart from the conductive layer 3 by means of an annular spacer boss 10 which is made of aluminium and into one side of which screws 11 are driven to secure the printed circuit board 1 and into the other side of which screws 12 are driven to secure the coaxial socket connector 8.

Figure 1:
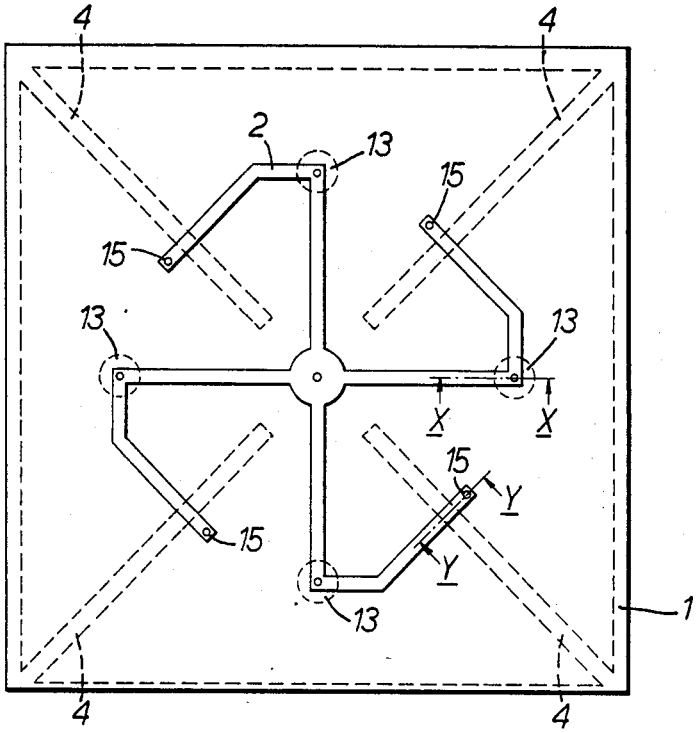
FIG. 1 is a plan view of an antenna.
Figure 2:
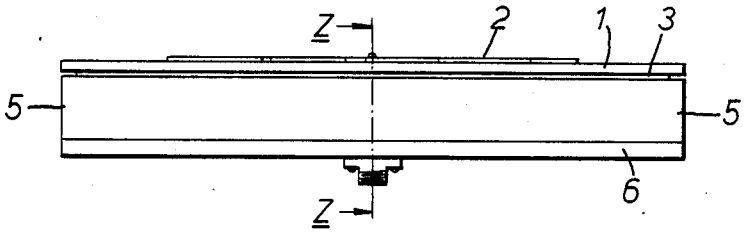
FIG. 2 is a side view of the antenna shown in FIG. 1.
Figure 3:
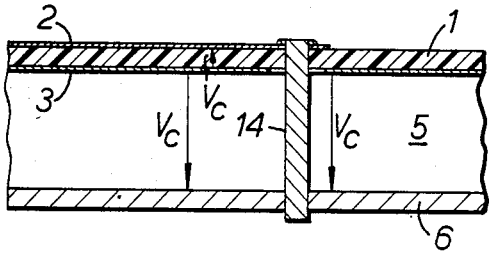
FIG. 3 is a sectional view on a line XX of a portion of the antenna shown in FIG. 1.
Figure 4:
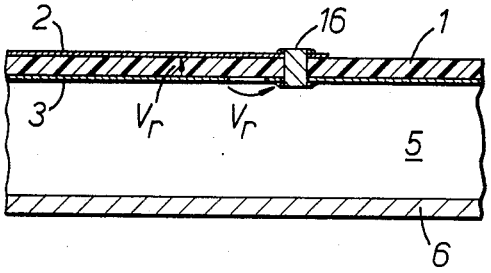
FIG. 4 is a sectional view on a line YY of a part of the antenna shown in FIG. 1.

At four regions 13 as shown in FIG. 1 the microstrip feedline 2 is connected through the printed circuit board 1 to the ground plane by means of conductors such as the conductor device 14 as shown in FIG. 3. The regions 13 are feed points for the edge slot 5. At four further regions 15, the microstrip feedline is connected through the printed circuit board 1 to the conductive layer 3 as shown in FIG. 4 whereby microwave energy is fed to the four radial slots 4. Connections between the micro strip feedline 2 and the conductive layer 3 are effected by means of through board connectors such as the connector 16 shown in FIG. 4.

By utilising a microwave antenna as just before described the generation of a circularly polarised annular radiation pattern is facilitated and a low profile configuration is afforded.

I claim:

1. An antenna suitable for the generation of a circularly polarised annular radiation pattern comprising a substrate spaced apart from a ground plane by a layer of dielectric material, the substrate being arranged to carry on one side thereof a conductive layer in which a plurality of radial slots is defined equiangularly disposed to extend outwardly from a central region of the substrate and on the other side thereof a microstrip feed line arrangement comprising printed conductors which are fed via a centrally disposed feed conductor from a coaxial connector, the printed conductors are linked through the substrate at a plurality of locations to the conductive layer for radial slot feeding purposes so that the radial slots are arranged to be fed with microwave energy for the generation of a horizontally polarized radiation pattern and which printed conductors are linked through the substrate and the layer of dielectric material to the ground plane at a plurality of further locations so as to feed an edge slot defined between the peripheral edge of the conductive layer and the ground plane such that the edge slot is fed with microwave energy for the generation of a vertically polarized radiation pattern and such that the horizontal pattern and the vertical pattern in combination afford the circularly polarized annular radiation pattern.

2. An antenna as claimed in claim 1 wherein four radial slots are provided arranged at 90° angular intervals to extend radially outwardly from the central region of the substrate to the peripheral edge of the conductive layer.

3. An antenna as claimed in claim 2 wherein the conductive layer is provided adjacent the layer of dielectric material.

4. An antenna as claimed in claim 3, wherein the coaxial connector is positioned on the ground plane side of the antenna.

5. An antenna as claimed in claim 4 wherein the edge slots are fed at four equiangularly disposed locations and the radial slots are each fed from a location adjacent to the feeding locations of each respective edge slot so that four feed locations are provided for the radial slots which are symmetrically disposed with respect to the central feed conductor.

* * * * *